US011179767B2

(12) United States Patent
Trinowski et al.

(10) Patent No.: US 11,179,767 B2
(45) Date of Patent: Nov. 23, 2021

(54) COMPOSITIONS AND METHODS FOR FOUNDRY CORES IN HIGH PRESSURE DIE CASTING

(71) Applicant: HA-INTERNATIONAL LLC, Westmont, IL (US)

(72) Inventors: Douglas M. Trinowski, Rochester Hills, MI (US); Michael J Walker, Shelby Township, MI (US)

(73) Assignee: HA-INTERNATIONAL LLC, Westmont, IL (US)

( * ) Notice: Subject to any disclaimer, the term of this patent is extended or adjusted under 35 U.S.C. 154(b) by 234 days.

(21) Appl. No.: 15/868,830

(22) Filed: Jan. 11, 2018

(65) Prior Publication Data

US 2018/0318912 A1 Nov. 8, 2018

Related U.S. Application Data

(60) Provisional application No. 62/445,140, filed on Jan. 11, 2017.

(51) Int. Cl.

| | |
|---|---|
| ***B22C 1/18*** | (2006.01) |
| ***B22C 3/00*** | (2006.01) |
| ***B22C 9/10*** | (2006.01) |
| ***B22D 29/00*** | (2006.01) |
| ***B22C 1/00*** | (2006.01) |

(Continued)

(52) U.S. Cl.

CPC ..... *B22C 1/188* (2013.01); *B22C 1/00* (2013.01); *B22C 1/02* (2013.01); *B22C 1/186* (2013.01); *B22C 3/00* (2013.01); *B22C 9/00* (2013.01); *B22C 9/10* (2013.01); *B22D 29/002* (2013.01)

(58) Field of Classification Search

CPC ..... B22D 29/00; B22D 29/002; B22C 1/00; B22C 1/02; B22C 1/18; B22C 1/186; B22C 1/188; B22C 3/00; B22C 9/00; B22C 9/10

USPC ..... 164/19, 20, 33, 72, 138, 132, 369

See application file for complete search history.

(56) References Cited

U.S. PATENT DOCUMENTS

| | | | |
|---|---|---|---|
| 3,445,250 | A | 5/1969 | Preece |
| 6,155,331 | A | 12/2000 | Langer et al. |
| 2008/0099180 | A1 | 5/2008 | Weicker et al. |

(Continued)

FOREIGN PATENT DOCUMENTS

| | | |
|---|---|---|
| CN | 1289655 | 4/2001 |
| CN | 106238670 | 12/2016 |

(Continued)

OTHER PUBLICATIONS

Jelinek et al., Lost Cores for High-Pressure Die Casting, Archives of Foundry Engineering, 2014, pp. 101-104, vol. 14, Issue Feb. 2014, Foundry Commission of the Polish Academy of Sciences, downloaded from PubFactory via free access.

(Continued)

*Primary Examiner* — Kevin P Kerns
(74) *Attorney, Agent, or Firm* — Clark Hill PLC

(57) ABSTRACT

"Lost" cores for use high pressure die casting, the cores preferably having a water-soluble synthetic ceramic aggregate having an appropriate strength and tolerance for various casting pressures and temperatures, an inorganic binder having sodium silicate, an additive having particulate amorphous silicon dioxide, and a refractory coating, wherein the cores have the capacity to be removed from a casting by dissolution with water.

16 Claims, 1 Drawing Sheet

(51) Int. Cl.
*B22C 1/02* (2006.01)
*B22C 9/00* (2006.01)

(56) References Cited

U.S. PATENT DOCUMENTS

| | | | |
|---|---|---|---|
| 2015/0144286 | A1 | 5/2015 | Bewlay et al. |
| 2016/0136724 | A1 | 5/2016 | Deters et al. |

FOREIGN PATENT DOCUMENTS

| | | | |
|---|---|---|---|
| DE | 10204055 | 8/2003 | |
| JP | 2007-083284 | 4/2005 | |
| JP | 2012-076114 | 4/2012 | |
| WO | 2009140775 | 11/2009 | |
| WO | 2011061593 | 5/2011 | |
| WO | WO 2011/110798 A1 * | 9/2011 | ..... B22C 3/00 |

OTHER PUBLICATIONS

Michels et al.. Suitability of Lost Cores in Rheocasting Process, Trans. Nonferrous Met. Soc. China, 2010, pp. s948-s953, Foundry Institute of RWTH Aachen, Germany, available online at www.sciencedirect.com.

Pavlik, R. S., Jr. et al. (2001). Thermal Decomposition of Zircon Refractories [Abstract]. Journal of the American Ceramic Society, 84(12), 2930-2936. doi:10.1111/j.1151-2916.2001.tb01117.x.

International Search Report which issued for PCT/US2018/013393 dated Mar. 28, 2018.

* cited by examiner

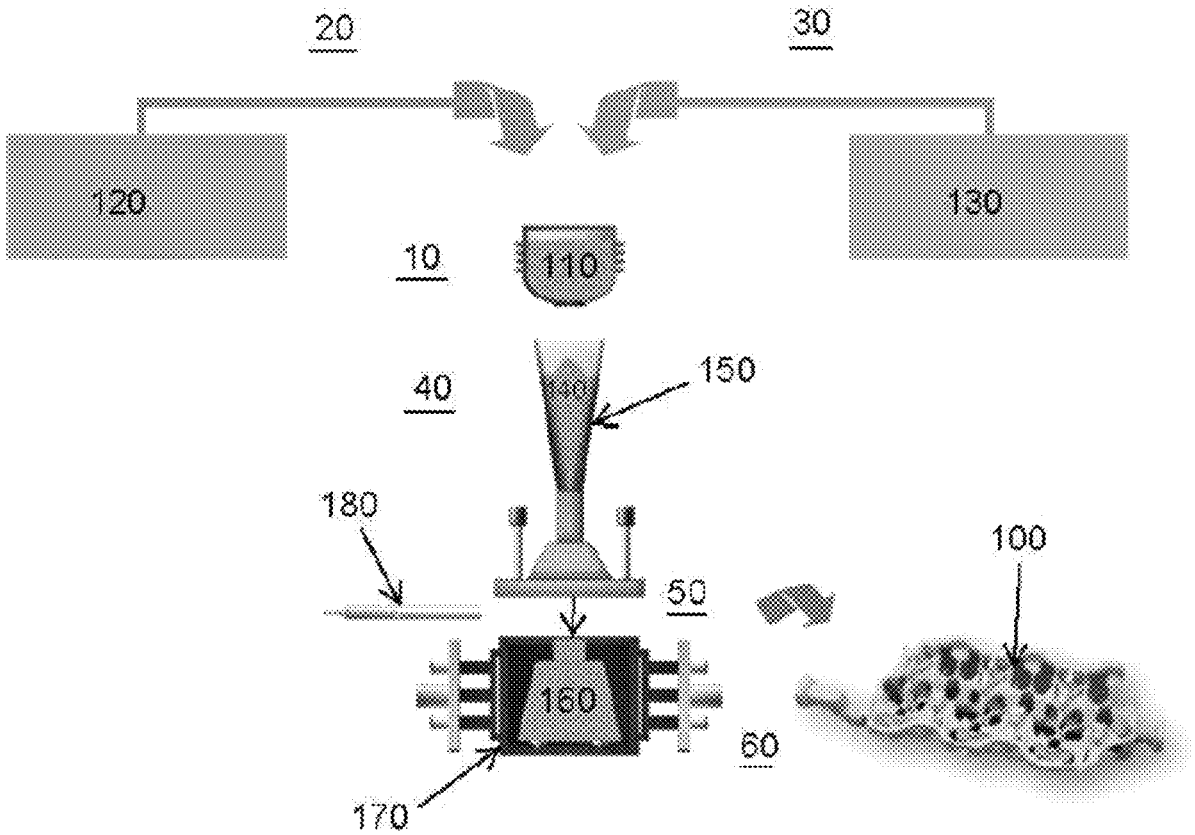
20
30
120
130
10
110
40
150
180
100
50
160
60
170

COMPOSITIONS AND METHODS FOR FOUNDRY CORES IN HIGH PRESSURE DIE CASTING

CROSS REFERENCE TO RELATED APPLICATIONS

This application claims priority to, and the benefit of, U.S. Provisional Patent Application Ser. No. 62/445,140 filed on Jan. 11, 2017.

FIELD OF THE INVENTION

This invention relates to casting cores used in high pressure die casting of the foundry industry. More specifically, this invention relates to "lost" cores for high pressure die casting comprising a water-soluble granular media having an appropriate strength and tolerance for various casting pressures and temperatures, as well as the capacity to be removed by dissolution after casting.

BACKGROUND OF THE INVENTION

The design and manufacturing of casting cores has created a constant challenge for foundries around the world. The growing demand for cores having very complex shapes, high strength, and qualities that allow the core to be readily removed from a casting requires that new materials for the core base, binders, and coatings be developed. At the same time, pressure to develop better cores is magnified by increasingly stringent environmental as well as health and safety regulations.

It is generally known that vehicle light-weighting with aluminum or magnesium alloys improves fuel economy and reduces emissions. This represents a complementary approach for hybrid and fuel cell vehicles to increase a vehicle performance, particularly range. A strategic vision of interest to Original Equipment Manufacturers around the world, particularly in view of United States Corporate Average Fuel Economy ("CAFE") compliance standards, is the reduction of vehicle weight by up to 20 percent ("%"). However, this vision has not been achieved to date, in part, due to barriers in manufacturing technologies.

Complex designs of certain automotive components require internal cavities or passages for functional purposes such as cylinders in engine blocks to avoid costly machining, or for weight reduction that avoids excess mass that otherwise offers no structural benefit. In order to manufacture a component with internal cavities during casting processes, it is necessary to install cores prior to metal pouring. A core, therefore, is a replica, in fact an inverse one, of the internal features of the part to be cast. Depending on the casting technique, cores can be completely integrated into the casting die/mold or loosely inserted therein. After solidification of the metal and release of the component, the core has to be broken, removed from the product, and usually disposed of although some applications of re-usable cores have been made. Depending on the casting method, when shifting from gravity casting to low pressure and to high pressure die casting ("HPDC"), the strength requirements for cores vary as melt pressure increases with each technique.

One particular type of core used in the aforementioned casting process is called a "lost" core. In one use example for lost cores, the core is comprised of a meltable, washable, or dissolvable composition that may be placed into the body of a mold and subsequently melted, washed out, and/or dissolved after casting. The removal of the core leaves behind a desired void in the cast metal object.

A significant technology gap exists in the application of lost cores for HPDC, seen as the technique of choice for large-scale manufacturing of structural automotive components. As a result, parts manufactured today by die casting do not commonly contain complex internal passages or cavities that would require breaking up the core before its removal. There have been attempts to apply water-soluble cores comprised of inorganic salts such as sodium chloride or potassium chloride. These cores may have appropriate strength for some applications and may be dissolved after casting, but their success has been limited. For example, salt water soluble squeezed cores from composite mixtures are limited in the size and shape of the formed lost core inherent in the manufacturing process. Salt cores suffer from cracking prior to casting and to erosion defects during the casting process. Additionally, salt cores are not easily removed from the casting after solidification and the resultant brine is corrosive and difficult to dispose or reclaim. Therefore, particular attention in the technology is focused on cores comprised of granular media such as sand or similar materials. A sand core technique has been applied to produce large, thin wall hollow metal cast shapes. However, the ablation casting process only uses a water soluble modified silicate resin. While optimal for ablation, it does not use the microsilica-based additive used in this invention. Consequently, the resultant cores do not possess the mechanical strength and humidity resistance of the current invention.

Accordingly, the prior art fails to address a longstanding unmet need in the art for casting cores that, on one hand, are strong enough to withstand high injection pressure commonly found in HPDC processes, particularly in gating areas, as well as pressure intensification during holding periods. On the other hand, the core should also easily break up during its removal after casting is completed. A development of a high-volume, low-cost casting process with an application of next generation casting cores will advance manufacturing allowing production of high-integrity components with full heat treatment capabilities.

SUMMARY OF THE INVENTION

To meet the needs described above, the present invention provides a lost core composition for use in HPDC to manufacture structural aluminum parts, wherein the lost core may be removed simultaneously during heat treatment of the aluminum casting by immersion in a solution such as water, thus allowing generation of complex, high integrity, hollow structural castings.

In this application HPDC refers to either high pressure die casting or vacuum high pressure die casting.

A preferred embodiment of the present invention includes a composition comprising a core for use in HPDC, the core comprising:

a) a refractory core base media comprised of a synthetic ceramic media of a preferred particle size and shape;
b) an inorganic binder preferably comprised of sodium silicate ("$Na_2SiO_3$" or "waterglass"), other inorganic modifiers, and a surfactant;
c) an additive comprising a particulate amorphous silicon dioxide ("$SiO_2$" or "silica"), wherein the additive is preferably obtained by thermal decomposition of zirconium silicate ("$ZrSiO_4$") to form zirconium dioxide ("$ZrO_2$" or "zirconia") and $SiO_2$;
d) wherein the binder and additive are mixed with the synthetic ceramic media preferably approximately at a 2:1 ratio of inorganic binder to additive, and typically from approximately 0.9-4.0% liquid binder (based on the weight of the ceramic media) to approximately 0.5-2.0% microsilica additive (based on the weight of the ceramic media) to form a mixture;

e) wherein the mixture is configured to be blown (preferably using air pressure) into a heated tool, such as a core box provided in the desired shape of the core; and f) wherein the mixture is cured at an elevated temperature, preferably between approximately 140-190 degrees Celsius ("° C.") to form the finished core.

The resulting composition, once cured into the desired core shape, provides an interconnected porosity in the manufactured core which allows a solution, such as that comprised of water, to penetrate and dissolve the core after casting. The unexpected benefits of the composition include: (i) high tensile strength of the resultant composition described above in lost core applications; (ii) resistance to molten aluminum in the HPDC process, which involves high metal pressure and velocity, thereby producing metal parts of enhanced quality; and (iii) the ability to remove the core from the casting with water during heat treatment. Cores provided in accordance with the present invention that are subsequently coated with the refractory coating are found to be resistant or perhaps fire-proof, thereby preventing molten aluminum from penetrating the surface of the core during HPDC.

An alternative preferred embodiment of the present invention includes a method of forming a core for use in HPDC, the method comprising the steps of:

a) providing a refractory core base media comprised of a synthetic ceramic media of a preferred particle size and shape;

b) providing an inorganic binder preferably comprising $Na_2SiO_3$, inorganic modifiers, and a surfactant;

c) providing an additive preferably consisting of particulate amorphous $SiO_2$, wherein the additive is preferably obtained by thermal decomposition of $ZrSiO_4$ to form $ZrO_2$ and $SiO_2$;

d) combining the binder and the additive with the synthetic ceramic media preferably approximately at a 2:1 ratio of inorganic binder to additive, and typically from approximately 0.9-4.0% liquid binder (based on the weight of the ceramic media) to approximately 0.5-2.0% microsilica additive (based on the weight of the ceramic media) to form a mixture;

e) blowing the mixture (preferably using air pressure) into a heated tool, such as a core box provided in the desired shape of the core; and f) curing the blown mixture at an elevated temperature, preferably between approximately 130-190° C., to form the finished core.

Another alternative preferred embodiment of the present invention is a foundry core for use in high pressure die casting, the foundry core comprising a combination of:

a synthetic ceramic aggregate;

an inorganic binder comprising sodium silicate;

an additive comprising particulate amorphous silicon dioxide;

wherein the inorganic binder and the additive are provided in the core at an approximate 2:1 weight ratio of inorganic binder to additive;

wherein the quantity of inorganic binder provided in the core ranges from approximately 0.9 to 4.0% inorganic binder by weight based on the weight of the synthetic ceramic aggregate; and wherein the quantity of additive provided in the core ranges from approximately 0.5 to 2.0% additive by weight based on the weight of the ceramic aggregate.

Yet another alternative preferred embodiment of the present invention is a method of forming a foundry core for use in high pressure die casting, the method comprising the steps of:

providing a synthetic ceramic aggregate;

providing an inorganic binder comprising sodium silicate;

providing an additive comprising particulate amorphous silicon dioxide;

combining the synthetic ceramic aggregate, the inorganic binder, and the additive to form a mixture, wherein the inorganic binder and the additive are provided in the mixture at an approximate 2:1 weight ratio of inorganic binder to additive, wherein the quantity of inorganic binder provided in the mixture ranges from approximately 0.9 to 4.0% inorganic binder by weight based on the weight of the synthetic ceramic aggregate, and wherein the quantity of additive provided in the mixture ranges from approximately 0.5 to 2.0% additive by weight based on the weight of the ceramic aggregate;

blowing the mixture into a heated tool provided in the desired shape of the foundry core; and curing the blown mixture at an elevated temperature that ranges from approximately 140 to 190 degrees Celsius.

Yet another alternative preferred embodiment of the present invention is a method of using a foundry core in high pressure die casting, the method comprising the steps of:

forming a foundry core by (i) providing a synthetic ceramic aggregate, (ii) providing an inorganic binder comprising sodium silicate, (iii) providing an additive comprising particulate amorphous silicon dioxide, (iv) combining the synthetic ceramic aggregate, the inorganic binder, and the additive to form a mixture, wherein the inorganic binder and the additive are provided in the mixture at an approximate 2:1 weight ratio of inorganic binder to additive, wherein the quantity of inorganic binder provided in the mixture ranges from approximately 0.9 to 4.0% inorganic binder by weight based on the weight of the synthetic ceramic aggregate, and wherein the quantity of additive provided in the mixture ranges from approximately 0.5 to 2.0% additive by weight based on the weight of the ceramic aggregate, (v) blowing the mixture into a heated tool provided in the desired shape of the foundry core, (vi) curing the blown mixture at an elevated temperature that ranges from approximately 140 to 190 degrees Celsius, (vii) applying a refractory coating to the foundry core after it is cured, and (viii) drying the refractory coating;

casting molten metal under high pressure around the foundry core and allowing the metal to solidify; and solubilizing the foundry core in an aqueous solution to dissolve the foundry core away from the metal.

BRIEF DESCRIPTION OF THE DRAWINGS

FIG. 1 depicts a graphic flow chart that depicts a method for making a foundry core provided in accordance with the present invention.

DETAILED DESCRIPTION OF THE EMBODIMENTS

While the present invention may be susceptible to embodiment in different forms, there is described herein in detail, specific preferred embodiments with the understanding that the present disclosure is to be considered an exemplification of the principles of the invention, and is not intended to limit the invention to that described herein.

A preferred embodiment of the present invention comprises a core for use in HPDC, the core comprising a granular media, an inorganic binder, and an additive. The granular media may be a natural silica sand, but it is preferably a synthetic ceramic material. The binder is preferably a water-soluble material capable of tolerating metal casting temperatures while also being removable by dissolution after casting.

The combined binder and the additive are preferably mixed with the granular media on an approximately 1.4-6% by weight ("wt %") and preferably approximately 4.2 wt % basis of binder and additive to media to form a mixture. The mixture is then preferably blown into a core box and cured using heated tooling and heated air. The ratio of binder and additive to granular media is such that there remains interconnected porosity in the manufactured core. This porosity allows a water based solution to penetrate into the core to dissolve it after casting.

More specifically, this preferred embodiment of the present invention comprises a granular media preferably comprising a synthetic ceramic or mullite aggregate combined with an inorganic binder and a flow additive to form a mixture. The inorganic binder preferably comprises modified sodium silicate liquid, and the flow additive preferably comprises a microsilica additive. Once the mixture is formed into a core, the core is coated with a refractory coating comprising zircon and/or tabular alumina applied to the resultant core shape to a certain wet and dry thickness.

The synthetic ceramic media of a preferred embodiment of the present invention is a sintered ceramic media preferably comprised of mullite and corundum crystals, which imparts on the media qualities of high hardness and durability that resist particle breakdown and result in a reduction of ceramic media consumption during the HPDC process. The use of synthetic ceramic media provides a thermally stable media that remains unaffected by HPDC process conditions. The media is preferably of a specific uniform size and shape that maximizes core porosity and enhances permeability. The preferred size of each ceramic media particle ranges from approximately 30-70 Grain Fineness Number ("GFN"), as measured by the American Foundry Society. Bulk density of the media ranges from approximately 90-115 pounds per cubic foot ("lbs/ft$^3$") loose and preferably approximately 113 lbs/ft$^3$ loose, and from approximately 105-130 lbs/ft$^3$ packed and preferably approximately 125 lbs/ft$^3$ packed. An example of a synthetic ceramic aggregate suitable for use in preferred embodiments of the present invention is Accucast® ID 50 manufactured and sold by Carbo Ceramics Inc. Another example of a synthetic ceramic media aggregate for use in preferred embodiments of the present invention is BAUXIT W65 synthetic ceramic aggregate.

A preferred chemical composition of the ceramic media found most useful in preferred embodiments of the present invention is as follows: aluminum oxide ("$Al_2O_3$") content from approximately 45-85 wt % and preferably approximately 75 wt %, $SiO_2$ content from approximately 9-40 wt %, titanium dioxide ("$TiO_2$") content from approximately 2-4 wt % and preferably approximately 3 wt %, and iron oxide ("$Fe_2O_3$") content from approximately 1-10 wt % and preferably approximately 9 wt %. These preferred ceramic media characteristics improve the cured strength of the resultant mixture to resist breakdown and erosion during the introduction of high velocity molten aluminum into a casting die comprising a core formed in accordance with the present invention. Furthermore, the combination of consistent ceramic media particle size and composition provides cured transverse strengths and cured tensile strengths of the cores fabricated using this type of ceramic media combined with the modified sodium silicate liquid binder and the microsilica additive that are at least 50% higher and 5-10% higher, respectively, than an aggregate core comprised primarily of silica sand.

Additionally, low linear expansion properties of the synthetic ceramic media used in preferred embodiments of the present invention increases the dimensional accuracy of the casting. Linear expansion values for the preferred ceramic media range from approximately 0.65-0.75 (% linear change and preferably approximately 0.71%, as measured from room temperature to 1,600° C.), whereas traditional expansion values for silica sand are significantly higher, most commonly at a 1.8% linear change.

In a preferred embodiment of the present invention, the inorganic binder is comprised mainly of sodium silicate, commonly referred to as waterglass. Modifiers, including boron, sodium, potassium, and lithium hydroxide may be added to the inorganic binder in order to optimize the cured properties of the cores formed in accordance with the present invention. Additionally, a surface-active material, such as a surfactant, may be added to the inorganic binder to improve the flowability of the resultant aggregate, binder, and additive mixture. An example of a binder suitable for use in preferred embodiments of the present invention is Cordis® 8511 binder manufactured and sold by Huettenes-Albertus, GmbH. An example of an additive suitable for use in preferred embodiments of the present invention is Anorgit™ 8396 binder manufactured and sold by Huettenes-Albertus, GmbH.

The additive of a preferred embodiment of the present invention preferably comprises microsilica. A suitable microsilica and method of making the same for use with the present invention is described in U.S. Pat. No. 7,770,629, which is incorporated in its entirety herein by reference. It has been found that among the amorphous silicon dioxides there are types which differ distinctly from the others in terms of their effect as an additive to a modified sodium silicate binder. If the additive added is particulate amorphous $SiO_2$ that was produced by thermal decomposition of $ZrSiO_4$ to form $ZrO_2$ and $SiO_2$, followed by an essentially complete or partial removal of $ZrO_2$, surprising large improvements in core tensile strength are obtained and/or the core weight is higher in cores formed in accordance with the present invention as compared to cores formed with particulate amorphous $SiO_2$ derived from other production processes. The increase in the core weight of cores formed in accordance with the present invention is found in cores having identical external dimensions of prior art cores (i.e., cores of the present invention comprise a greater density), and the increased core weight is accompanied by qualities of decreased gas permeability, which is indicative of tighter packing of the core media particles. Notably, a closely packed core with high density still retains the open port spacing of the base aggregate that allows for water removal after casting. The particulate amorphous $SiO_2$ produced according to the above method is also known as synthetic amorphous $SiO_2$.

A core formed in accordance with the present invention comprises:

a) a refractory core base media comprised of a synthetic ceramic media of a preferred particle size and shape;
b) an inorganic binder preferably comprised of $Na_2SiO_3$, other inorganic modifiers, and a surfactant;

c) an additive consisting of particulate amorphous $SiO_2$, wherein the additive is preferably obtained by thermal decomposition of $ZrSiO_4$ to form $ZrO_2$ and $SiO_2$; and d) wherein the binder and additive are mixed with the synthetic ceramic media preferably approximately at a 2:1 ratio of inorganic binder to additive, and typically from approximately 0.9-4.0% liquid binder (based on the weight of the ceramic media) to approximately 0.5-2.0% microsilica additive (based on the weight of the ceramic media) to form a mixture;

e) wherein the mixture is configured to be blown (preferably using air pressure) into a heated tool, such as a core box provided in the desired shape of the core; and f) wherein the mixture is cured at an elevated temperature, preferably between approximately 130-190 degrees Celsius (° C.) to form the finished core.

As shown in FIG. 1, an alternative preferred embodiment of the present invention includes a method of forming a core 100 for use in HPDC, the method comprising the steps of:

a) (Process Step 10) providing a refractory core base media 110 comprised of a synthetic ceramic media of a preferred particle size and shape;

b) (Process Step 20) providing an inorganic binder 120 preferably comprising $Na_2SiO_3$, inorganic modifiers, and a surfactant;

c) (Process Step 30) providing an additive 130 preferably consisting of particulate amorphous $SiO_2$, wherein the additive 130 is preferably obtained by thermal decomposition of $ZrSiO_4$ to form $ZrO_2$ and $SiO_2$;

d) (Process Step 40) combining in a mixer 150 the binder 120 and the additive 130 with the synthetic ceramic media 110 preferably approximately at a 2:1 ratio of inorganic binder 120 to additive 130, and typically from approximately 0.9-4.0% liquid binder 120 (based on the weight of the ceramic media 110) to approximately 0.5-2.0% microsilica additive 130 (based on the weight of the ceramic media 110) to form a mixture 140;

e) (Process Step 50) blowing the mixture 140 (preferably using air pressure) into a heated tool, such as a core box 170 provided in the desired shape of the core 100; and f) (Process Step 60) curing the blown mixture 160 at an elevated temperature, preferably between approximately 140-190° C. in the core box, the curing process being augmented by the use of hot air gassing 180 to form the finished core 100.

The binder, additive, and aggregate substrate need a homogeneous mix to produce cores formed in accordance with the present invention. Mixing time depends on the requirements of the mixer. In general, cores formed in accordance with the present invention are preferably made by combining the following in order: aggregate first, followed by the microsilica modified dry powder additive, followed by modified silicate liquid binder. In general, two minutes of mixing the dry additive powder into the aggregate, followed by two minutes of mixing in the modified silicate liquid binder should be sufficient, but times may vary depending on the type of mixer employed. The aggregate mixture can be prepared in any commercial batch mixer. Mixers known in the industry such as a concurrent stator-type mixers and S blade-type mixers are effective.

The amount of modified silicate liquid binder added to the aggregate depends on the average particle size and purity of the aggregate media, and is preferably between approximately 0.9-4.0% based on the weight of the aggregate, and more preferably 2.0-2.8 wt %. The amount of microsilica additive powder used is preferably between approximately 0.5-2.0% based on the weight of the aggregate, and more preferably 1.0-1.4 wt %.

Once a homogenous mix is obtained, the mixture is ready for core or mold production. In a preferred embodiment of the present invention, the aggregate mixture is shot into a heated core box in the shape of the desired part. Depending on core geometry, the core box temperature ranges between approximately 140° C. (284° F.) and 190° C. (374° F.). The heat in the core box should be distributed homogeneously. After the aggregate mixture (i.e., synthetic mullite, water-borne binder, and additive) has reached the core box, a peripheral shell is formed around the outer contour of the core. The curing process that follows is supported and accelerated by injecting the shaped mixture within the tooling with heated air. Applying hot gas, preferably at a temperature ranging from 100 to 200° C., to the core in the core box also helps to accelerate the curing process. Depending on the aggregate and amounts of microsilica additive powder and modified silicate liquid binder employed, bending strength levels ranging from approximately 350-1000 Newtons per centimeter squared ("$N/cm^2$") can be achieved with binder addition rates of approximately 1.5-3.5 wt %. For the United States, using the AFS standard tensile specimens, tensile strengths that range from approximately 300-800 pounds per square inch ("psi") can be achieved using binder addition rates of approximately 1.5-6.0 wt %.

The hardening time of such inorganically bonded cores greatly depends on their volume and geometry. Suggested starting parameters depend upon the specific core equipment used. General settings for a core-blowing machine typically employed in the industry for fabricating core shapes and used for the inorganic lost core formation process of the present invention are:

a) Shooting Pressure (bar): approximately 3 to 5, 3.5 bar typical b) Shooting Time (seconds): approximately 0.5-2 c) Purge Time (seconds): approximately 35-60 d) Purge Pressure (bar): approximately 2 e) Purge Heater Temperature (° C.): approximately 100-240 f) Core Box Temperature (° C.): approximately 120-150

After curing, the resulting core formed in accordance with preferred embodiments of the present invention is covered with a refractory coating to further protect the cured core shape against molten aluminum, which is injected into HPDC molds at elevated temperatures (approximately 700-800° C.) and under high pressure (approximately 250-400 bar) and velocity (approximately 2.5 meters/second).

The coating used in this application and provided in accordance with this invention is preferably a specially formulated material containing high density tabular aluminum oxide as a refractory system and/or a blend of high density tabular aluminum oxide and zircon as refractory system. The refractory coatings used are preferably comprised of between approximately 75-100% tabular aluminum oxide and approximately 0-25% zircon. Both component materials are present as fine powders, the tabular alumina being roughly 325 Mesh and the zircon being roughly 200 Mesh. Both require use of a special refractory coating binder to adhere the refractory coating to the surface of the cured aggregate core shape, such as gum rosin used at between approximately 0.5-0.9 wt % in the refractory coating.

The refractory coatings, either as a blend as described above or as a single refractory comprising tabular aluminum oxide only constitute approximately 60-65 wt % of the coating mixture. The remainder of the coating is either water or isopropyl alcohol employed as a solvent, clays such as a bentonite, surfactants, and dispersants. Water and alcohol comprise approximately 20-25 wt % of the coating as a carrier solvent. The balance of the coating is comprised of the clays, surfactants, and wetting agents typically employed in refractory coating design.

Either refractory coating can be further diluted with isopropyl alcohol and have its respective flow adjusted to the application method of choice. These types of coatings can be applied to the surface of a cured aggregate core surface provided in accordance with the present invention by several methods commonly used in the industry. Such methods include dipping, either by hand or via a robotic manipulator, flow-coating, or flooding.

Particularly important is the amount of such coating applied to the surface of the cured core. The above coatings will apply from 8-12 mils wet thickness, depending upon the contact time with core. A mil is $1/1000^{th}$ of an inch. Casting results are found to be best when two coats of the specified coating is applied to the core giving a total wet thickness of approximately 10-20 mils, and a dry coating thickness of approximately 0.008-0.015 inches.

The coating after application is allowed to dry. Drying can be accomplished by air drying, microwave curing, or drying in a forced air oven. Dry times depend upon the method employed. The aforementioned coatings provide a very hard and durable surface after drying, referred to as an "egg-shell" coating. This hard, durable surface insures the surface integrity of the coated aggregate core up until the casting process. Furthermore, the hard, durable surface of suitable thickness resists metal impingement into the core during the vacuum HPDC process.

Once a casting is extracted, the core provided in accordance with the present invention is solubilized in water, which provides solution heat treatment to the casting and dissolves the core material away from the casting. The inorganic binder components can be further treated and reclaimed.

Example #1—Tensile Strength of Cores

Test specimens of cores, one comprising a core base media of standard silica sand and another provided in accordance with a preferred embodiment of the present invention comprising a core base media of synthetic ceramic aggregate, were tested according to the foundry sand process described in the AFS Mold and Core Test Handbook, namely Test Procedure Nos. 3301-08-S, 5223-13-S, 3315-00-S, 1105-12-S, 1114-00-S, 5100-12-S, and 1106-12-2, which are incorporated herein by reference in their entirety. In this test, test specimens using an inorganic binder system comprising Cordis® 9032 and Anorgit™ 8396, both manufactured and sold by Huettenes-Albertus, GmbH, were made. One specimen comprised a core base media of standard silica sand typically used for coremaking in the foundry industry, namely Wedron™ 530 manufactured and sold by Fairmount Santrol, and another specimen comprised a core base media of synthetic ceramic aggregate, namely Accucast® ID 50 manufactured and sold by Carbo Ceramics Inc. 5000 grams of the core base media were mixed with the inorganic binders using a KitchenAid® mixer according to typical procedures, namely, AFS 3315-00-S. A single binder system level was evaluated, 2.8% Cordis 9032 binder with 1.4% Anorgit 8396 additive (based on the weight of the aggregate). After mixing, the aggregate/inorganic binder mixture was blown (by air pressure) into a core box in the shape of tensile specimens on a Laempe L1-3 core blower. Curing conditions for preparing the specimens is shown below:

| | |
|---|---|
| Core Box Temperature | 150° C. |
| Cure Time | 60 seconds |
| Blow Time | 0.5 seconds |
| Hot Air | 100° C. |
| Shoot Pressure | 4 bar |
| Final Purge Pressure | 2 bar |

After curing, the specimens were tested for maximum tensile strength using a Thwing-Albert tensile tester. Tensile strengths were determined 1 hour and 24 hours after curing. The cured 24 hours specimens were also tested for permeability in accordance with AFS 5223-13-S.

Results were as follows:

| Aggregate | | |
|---|---|---|
| Component | Wedron 530 | Accucast ID 50 |
| Cordis 9032 | 2.8% | 2.8% |
| Anorgit 8396 | 1.4% | 1.4% |

| Tensile Strength, psi | | |
|---|---|---|
| 1 hour | | |
| | 708 | 874 |
| | 766 | 849 |
| | 713 | 779 |
| Average | 729 | 834 |
| 24 hour | | |
| | 773 | 873 |
| | 770 | 815 |
| | 798 | 853 |
| | 770 | 792 |
| | 774 | 844 |
| | 771 | 814 |
| Average | 776 | 832 |
| Permeability | | |
| Permeability using 24 hr specimens | 150 | 240 |
| | 120 | 220 |
| | 120 | 230 |
| Average | 130 | 230 |

Actual particle size analysis was made pursuant to AFS Nos. 1105-12-S and 1106-12-2 for the Wedron™ 530 silica and Accucast® ID 50 aggregates, as shown below. "ADV" is Acid Demand Value per AFS 1114-00-S and "LOT" is Loss On Ignition per AFS 5100-12-S.

| AFS Screen Analysis | | | | | | | |
|---|---|---|---|---|---|---|---|
| Sample: | | Wedron 530 | | | Accucast ID 50 | | |
| Screen No. | Multiplier | Grams | Retained, % | Product | Grams | Retained, % | Product |
| 30 | 0.20 | 0.00 | 0.00 | 0.00 | 0.03 | 0.03 | 0.01 |
| 40 | 0.30 | 0.27 | 0.27 | 0.08 | 0.28 | 0.28 | 0.08 |
| 50 | 0.40 | 29.00 | 28.85 | 11.54 | 35.14 | 35.15 | 14.06 |
| 70 | 0.50 | 36.73 | 36.54 | 18.27 | 44.71 | 44.72 | 22.36 |
| 100 | 0.70 | 20.99 | 20.88 | 14.62 | 19.58 | 19.59 | 13.71 |
| 140 | 1.00 | 10.32 | 10.27 | 10.27 | 0.17 | 0.17 | 0.17 |
| 200 | 1.40 | 2.99 | 2.97 | 4.16 | 0.03 | 0.03 | 0.04 |
| 270 | 2.00 | 0.23 | 0.23 | 0.46 | 0.02 | 0.02 | 0.04 |
| Pan | 3.00 | 0.00 | 0.00 | 0.00 | 0.01 | 0.01 | 0.03 |
| TOTALS: | | 100.53 | 100.00 | | 99.97 | 100.00 | |
| Grain Fineness Number | | | 59.4 | | | 50.5 | |
| pH | | | 7.1 | | | 6.3 | |
| ADV, mL | | | 0.0 | | | −0.6 | |
| LOI, % | | | 0.07 | | | 0.03 | |

Example #2A—Transverse Strength of Cores

Several test specimens of cores were made according to typical foundry sand core test processes, some comprising a core base media of standard silica sand and others provided in accordance with a preferred embodiment of the present invention comprising a core base media of synthetic ceramic aggregate, namely Accucast® ID 50. Core transverse strengths were tested using either an organic cold-box binder system, namely SIGMA CURE 7211 Part 1 and 7706 Part 2 cured with SIGMA CAT 2185, all manufactured and sold by HA International, or an inorganic binder system, namely Cordis® 8511 binder and Anorgit™ 8396 additive. The cores were formed using methods appropriate and typical for the forming of a test piece core with either both silica sand or a synthetic ceramic aggregate, as will be appreciated by one of ordinary skill in the art.

After fully curing, the test cores were placed in a fixture and transverse strengths at failure load were determined, by so-called 3-point bending, using an Instron® testing instrument, manufactured and sold by Illinois Tool Works Inc. The results are as follows:

| 3 point bend test cores | | | | | | |
|---|---|---|---|---|---|---|
| Sample | binder | Cordis/Anorgit | granular media | weight (g) | rate 1 mm/minute Maximum Load ($N/cm^2$) | sets of three average load (N/cm2) |
| 1 org | organic cold-box | | silica sand | 2063 | 1,978 | 1,642 |
| 2 org | organic cold-box | | silica sand | 2055 | 1,979 | |
| 3 org | organic cold-box | | silica sand | 2052 | 968 | |
| 2 IS | inorganic | 2%/1% | silica sand | 2148 | 1,467 | 1,465 |
| 3 IS | inorganic | 2%/1% | silica sand | 2153 | 1,442 | |
| 4 IS | inorganic | 2%/1% | silica sand | 2157 | 1,487 | |
| 21 IS | inorganic | 3%/1.5% | silica sand | 2160 | 2,002 | 2,154 |
| 25 IS | inorganic | 3%/1.5% | silica sand | 2161 | 1,946 | |
| 29 IS | inorganic | 3%/1.5% | silica sand | 2160 | 2,514 | |
| 40 IS | inorganic | 4%/2% | silica sand | 2202 | 1,607 | 2,410 |
| 43 IS | inorganic | 4%/2% | silica sand | 2196 | 3,783 | |
| 44 IS | inorganic | 4%/2% | silica sand | 2199 | 1,840 | |
| 4 IP | inorganic | 2%/1% | Accucast ID 50 | 2493 | 3,040 | 3,012 |
| 8 IP | inorganic | 2%/1% | Accucast ID 50 | 2487 | 3,074 | |
| 13 IP | inorganic | 2%/1% | Accucast ID 50 | 2502 | 2,923 | |
| 26 IP | inorganic | 3%/1.5% | Accucast ID 50 | 2521 | 3,713 | 4,104 |
| 29 IP | inorganic | 3%/1.5% | Accucast ID 50 | 2525 | 4,771 | |
| 33 IP | inorganic | 3%/1.5% | Accucast ID 50 | 2511 | 3,828 | |
| 36 IP | inorganic | 4%/2% | Accucast ID 50 | 2513 | 2,914 | 3,595 |
| 38 IP | inorganic | 4%/2% | Accucast ID 50 | 2529 | 4,060 | |
| 39 IP | inorganic | 4%/2% | Accucast ID 50 | 2536 | 3,810 | |

As shown above, the combination of a synthetic ceramic aggregate and an inorganic binder demonstrates superior transverse strength and performance.

Example #2B—Transverse Strength of Cores

Several test specimens of cores were made according to typical foundry sand core test processes. Cordis® 8511 binder and Anorgit™ 8396 additive were mixed with different aggregates at 2.0 wt % and 2.8 wt % for Cordis® and 1.0 wt % and 1.4 wt % for Anorgit™. In this example, the aggregate molding materials were selected from Accucast® ID50, CERABEADS 400 manufactured and sold by Naigai Itochu, BAUXIT W65 manufactured and sold by Ziegler &

Co. GmbH, and silica sand F34 manufactured and sold by Quarzwerke. All strengths were typical European Union transverse or "bending" specimens.

Curing parameters were as follows: (i) Curing and gassing temperature: 160° C.; (ii) curing time: 30 seconds.

First trial was with the original molding materials 2.8% Cordis® 8511 and 1.4% Anorgit™ 8396, coated with Arkopal® 6804 modified and Arkopal® E MS 97, both of which are water-based finishing coatings applied to cores to provide the cores with a smooth surface.

Transverse strengths were determined using Morek Multisery transverse tester and following the German procedure Merkblatt R 202 des Vereins Deutscher Gießereifachleute, Ausgabe Oktober 1976. All strengths reported are in N/cm$^2$, as shown below.

| Sand | Binder | Addition Rate [%] | Additive | Addition Rate [%] | Core weight [g] | Cold strength [N/cm$^2$] |
|---|---|---|---|---|---|---|
| Silica sand F34 | 8511 | 2.8 | 8396 | 1.4 | 138.26 | 437 |
| Silica sand F34 | 8511 | 2.8 | 8396 | 1.4 | 138.26 | 437 |
| Silica sand F34 | 8511 | 2.0 | 8396 | 1.0 | 137.69 | 287 |
| Silica sand F34 | 8511 | 2.0 | 8396 | 1.0 | 137.69 | 287 |
| Accucast ID 50 | 8511 | 2.8 | 8396 | 1.4 | 176.97 | 707 |
| Accucast ID 50 | 8511 | 2.8 | 8396 | 1.4 | 176.97 | 707 |
| Bauxit W65 | 8511 | 2.8 | 8396 | 1.4 | 196.38 | 1,706 |
| Bauxit W65 | 8511 | 2.8 | 8396 | 1.4 | 197.06 | 1,597 |
| Bauxit W65 | 8511 | 2.0 | 8396 | 1.0 | 193.70 | 1,112 |
| Bauxit W65 | 8593 | 2.0 | 8396 | 1.0 | 193.77 | 1,237 |
| Bauxit W65 | 8511 | 2.0 | 8396 | 1.0 | 193.70 | 1,112 |
| Bauxit W65 | 8593 | 2.0 | 8396 | 1.0 | 193.77 | 1,237 |
| Cerabeads 400 | 8511 | 2.8 | 8396 | 1.4 | 141.35 | 431 |
| Cerabeads 400 | 8511 | 2.8 | 8396 | 1.4 | 141.90 | 443 |
| Cerabeads 400 | 8511 | 2.8 | 8396 | 1.4 | 141.85 | 413 |
| Cerabeads 400 | 8511 | 2.8 | 8396 | 1.4 | 141.85 | 413 |
| Cerabeads 400 | 8511 | 2.8 | 8396 | 1.4 | 141.85 | 413 |
| Cerabeads 400 | 8511 | 2.8 | 8396 | 1.4 | 142.11 | 401 |
| Cerabeads 400 | 8511 | 2.8 | 8396 | 1.4 | 142.11 | 401 |
| Cerabeads 400 | 8511 | 2.8 | 8396 | 1.4 | 142.11 | 401 |

Comparing the different aggregates used in relation to the cold strength, the Bauxit W65 synthetic ceramic material showed the highest strengths with both low and high binder levels. All synthetic ceramic aggregates develop significantly higher transverse strengths than traditional silica sand.

Example #4—Coating the Foundry Core

Test cores were made in accordance with the process used for Example #2. Cordis® 8511 binder at 2.0 wt % and 2.8 wt % and Anorgit™ 8396 additive at 1.0 wt % and 1.4 wt % were mixed with Accucast® ID 50 synthetic ceramic media using typical foundry mixing equipment. The mixture was then blown and cured according to recommended practice for curing inorganic cores.

The cores were then coated with Mold Lite® Plus T and TZ manufactured and sold by HA International LLC. Mold Lite® PLUS T is a high solids alcohol based refractory coating. This product preferably uses high density tabular aluminum oxide as a refractory system. Mold Lite® PLUS TZ is a high solids alcohol based refractory. This product is a predominantly aluminum oxide refractory system blended with some zircon. The rheological additives used in these coatings are such that once the coating is dry, a hard "egg shell" refractory layer about 5-10 mils dry thickness remains, which protects the cores during handling and provides a protective refractory barrier that resists the impingement of molten aluminum during the high pressure die casting process. The cores were dipped in the respective coatings, which were at approximately 58° Baumé and about 12.7-12.8 lbs/gallon (typical methods used in foundry industry for controlling refractory coatings). These coatings utilize either 100% tabular alumina (325 Mesh) or a 50:50 blend of zircon flour (200 Mesh) and tabular alumina (325 Mesh). The cores were flow coated once in the coating fluid and left to air dry. Some of the cores flow coated a second time in the respective coatings to provide an additional layer of refractory. Wet thicknesses were approximately 10-15 mils and approximately 5-10 mils thick after drying.

With regard to trade names or marks used herein, BAUXIT W65 is a synthetic ceramic aggregate, CORDIS 9032 is a foundry resin, ANORGIT 8396 is a foundry resin, WEDRON 530 is silica sand, Accucast® ID 50 is a synthetic ceramic aggregate, SIGMA CURE and SIGMA CAT are cold-box binder systems.

The invention claimed is:

1. A method of forming a foundry core for use in high pressure die casting, the method comprising the steps of:

providing a synthetic ceramic aggregate;

providing an inorganic binder comprising sodium silicate;

providing an additive comprising particulate amorphous silicon dioxide;

combining the synthetic ceramic aggregate, the inorganic binder, and the additive to form a mixture, wherein the quantity of inorganic binder provided in the mixture ranges from approximately 0.9 to 4.0% inorganic binder by weight based on the weight of the synthetic ceramic aggregate, and wherein the quantity of additive provided in the mixture ranges from approximately 0.5 to 2.0% additive by weight based on the weight of the ceramic aggregate;

blowing the mixture into a heated tool provided in a desired shape of the foundry core;

curing the blown mixture at an elevated temperature that ranges from approximately 140 to 190 degrees Celsius; and applying a refractory coating comprising tabular alumina to the foundry core after it is cured.

2. The method of claim 1 further comprising the steps of: applying a refractory coating to the foundry core after it is cured; and drying the refractory coating.

3. The method of claim 2, wherein the refractory coating comprises high density tabular aluminum oxide.

4. The method of claim 2, wherein the coating is applied to the foundry core to a total wet thickness ranging from approximately 10 to 20 mils.

5. The method of claim 1, wherein the quantity of inorganic binder provided in the core ranges from approximately 2.0 to 2.8% inorganic binder by weight based on the weight of the synthetic ceramic aggregate.

6. The method of claim 1, wherein the quantity of additive provided in the core ranges from approximately 1.0 to 1.4% additive by weight based on the weight of the synthetic ceramic aggregate.

7. The method of claim 1, wherein the synthetic ceramic aggregate comprises a grain fineness number that ranges from approximately 30 to 70.

8. The method of claim 1, wherein the synthetic ceramic aggregate comprises a grain fineness number that ranges from approximately 50 to 65.

9. The method of claim 1, the inorganic binder further comprising an inorganic modifier.

10. The method of claim 9, wherein the inorganic modifier is lithium hydroxide.

11. A method of using a foundry core in high pressure die casting, the method comprising the steps of:

forming a foundry core by (i) providing a synthetic ceramic aggregate, (ii) providing an inorganic binder comprising sodium silicate, (iii) providing an additive comprising particulate amorphous silicon dioxide, (iv) combining the synthetic ceramic aggregate, the inorganic binder, and the additive to form a mixture, wherein the quantity of inorganic binder provided in the mixture ranges from approximately 0.9 to 4.0% inorganic binder by weight based on the weight of the synthetic ceramic aggregate, and wherein the quantity of additive provided in the mixture ranges from approximately 0.5 to 2.0% additive by weight based on the weight of the ceramic aggregate, (v) blowing the mixture into a heated tool provided in the desired shape of the foundry core, (vi) curing the blown mixture at an elevated temperature that ranges from approximately 140 to 190 degrees Celsius, (vii) applying a refractory coating comprising tabular alumina to the foundry core after it is cured, and (viii) drying the refractory coating;

casting molten metal under high pressure around the foundry core and allowing the metal to solidify; and solubilizing the foundry core in an aqueous solution to dissolve the foundry core away from the metal.

12. The method of claim 11, further comprising the step of reclaiming the inorganic binder after dissolution from the metal for use in a second foundry core.

13. The method of claim 12, wherein the aqueous solution is water.

14. The method of claim 11, the inorganic binder further comprising an inorganic modifier.

15. The method of claim 14, wherein the inorganic modifier is lithium hydroxide.

16. The method of claim 11, wherein the molten metal is aluminum and the high pressure is at least 250 bar.

* * * * *